US005713383A

United States Patent [19]

Ramirez et al.

[11] Patent Number: 5,713,383

[45] Date of Patent: Feb. 3, 1998

[54] BEACH BLANKET ANCHOR

[75] Inventors: Yvonne E. Ramirez, St. Petersburg, Fla.; Martin A. Carlton, Issaquah, Wash.

[73] Assignee: YUM Incorporated, St. Petersburg, Fla.

[21] Appl. No.: 693,959

[22] Filed: Aug. 7, 1996

[51] Int. Cl.[6] ..... E04H 15/62

[52] U.S. Cl. ..... 135/118; 5/417; 5/419; 248/545; 248/156

[58] Field of Search ..... 135/118, 119; 5/417–420; 248/508, 499, 545, 156

[56] References Cited

U.S. PATENT DOCUMENTS 4,914,767 4/1990 Balicki et al. ..... 135/118 X
4,927,118 5/1990 Pierorazio ..... 135/118 X
5,170,812 12/1992 Caillat .
5,176,354 1/1993 Feigenbaum .
5,327,922 7/1994 Deroche .
5,390,890 2/1995 Ferguson et al. .
5,474,275 12/1995 Robertson et al. .
5,524,309 6/1996 La Barbera .
5,579,798 12/1996 Pruitt .

*Primary Examiner*—Lanna Mai
*Attorney, Agent, or Firm*—Christensen, O'Connor, Johnson & Kindness PLLC

[57] ABSTRACT

An anchor (10) for blankets, towels and the like comprising a clamp (22) located atop a post (20). The clamp comprises a base piece (24) and a head piece (40) hingedly attached to one another by a pin (50). A coil spring (60) mounted in the pin urges the teeth (32, 42) of the clamp closed. Alternatively, flipper tabs (70) can be used to hold the teeth closed.

10 Claims, 2 Drawing Sheets

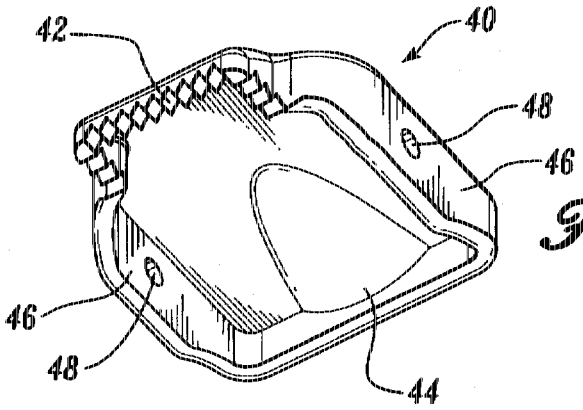
Fig. 3
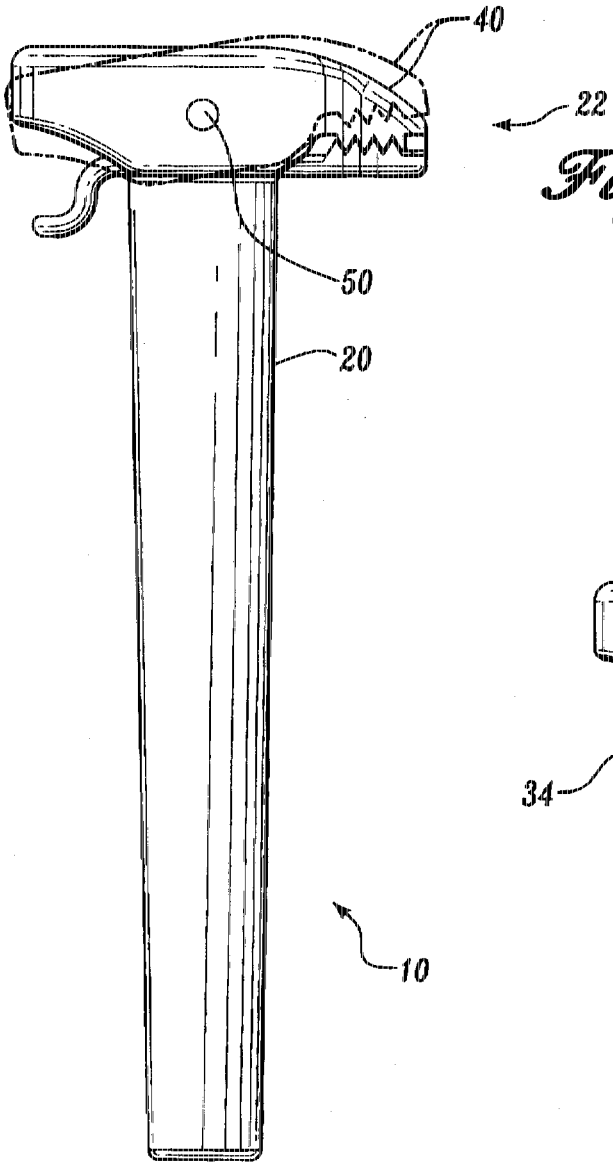
Fig. 4
Fig. 5
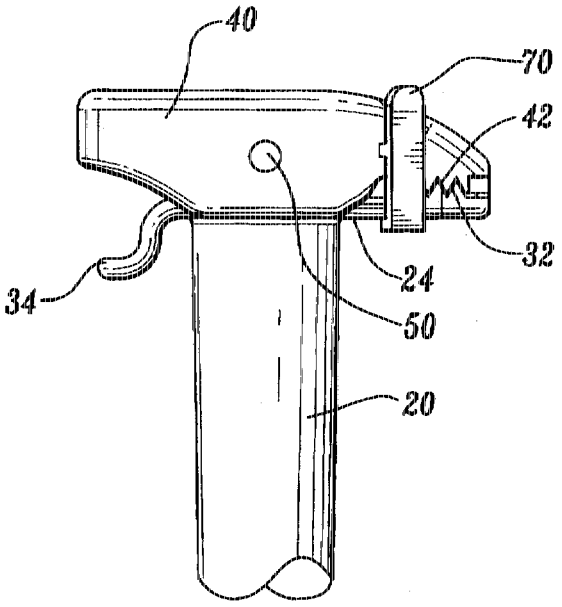

BEACH BLANKET ANCHOR

FIELD OF THE INVENTION

The present invention is generally directed to anchors and, more specifically, to anchors for anchoring beach blankets and the like.

BACKGROUND OF THE INVENTION

Blankets, towels, tarpaulins and the like are used on beaches, in parks and other environments to provide a clean or soft surface for people to He on or to spread out articles, such as a picnic meal. As people move on and off blankets, towels, etc., they move and bunch up. Medium-to-high wind force also affects the layout of blankets, towels and the like. In order to prevent the ruffling and bunching up of spread-out blankets, towels and the like, various proposals to anchor such items to the ground have been made. To date, such proposals have not been entirely satisfactory.

Accordingly, a need exists for a device for anchoring blankets, towels and the like to the ground. Such a device should be easy to install yet strong enough to withstand the force applied to blankets, towels and the like spread on the ground by people walking on the blanket or towel and by the wind. The present invention is directed to providing such a device.

SUMMARY OF THE INVENTION

In accordance with this invention, an anchor for a blanket, towel or the like spread on the ground, such as on beach sand, is provided. The anchor includes a clamp suitable for engaging the edge of a blanket, towel or the like. The anchor also includes a post suitable for being driven into the ground. The clamp is located atop the post.

In accordance with other aspects of this invention, the clamp is formed of two pieces. One piece, the base piece, is located atop the post. The second piece, the head piece, is hingedly affixed to the first clamp piece. The parts of the pieces located on one side of the hinge form a jaw for griping the edge of a blanket, towel or the like. The parts of the pieces located on the other side of the hinge are manually operable to open the jaw.

In accordance with further aspects of this invention, the base and head clamp pieces are joined by a pin.

In accordance with still other aspects of this invention, the jaws include teeth that face one another.

In accordance with still other further aspects of this invention, the clamp is spring loaded, preferably by a coil spring surrounding the pin. The coil spring produces a force that closes the jaw.

In accordance with alternative aspects of this invention, the jaw is latched closed by a latching mechanism.

In accordance with yet other aspects of the present invention, the base piece of the clamp is integrally formed with the post. Preferably, the base piece/clamp combination and the head piece are molded from a high-strength plastic.

In accordance with yet still other aspects of this invention, the post is tapered and, preferably, hollow.

In accordance with other further aspects of this invention, the piece of the clamp located atop the post, i.e., the base piece, includes a downwardly protruding tab and the other piece, i.e., the head piece, includes a recess. The tab and the recess co-act to allow a user to readily grasp and open the jaws of the clamp.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 3 is a perspective view of the underside of the head piece of the beach blanket anchor illustrated in FIG. 1;

FIG. 4 is a side elevation of the beach blanket anchor illustrated in FIG. 1; and FIG. 5 is a side elevation of an alternative embodiment of a beach blanket anchor formed in accordance with the invention.

DETAILED DESCRIPTION OF THE PREFERRED EMBODIMENT

In general, the present invention is directed to an anchor for blankets, towels or the like spread on the ground. Embodiments of the invention are ideally suited for anchoring a blanket on a windy beach. Anchors formed in accordance with the invention include a clamp and a post. The clamp is mounted atop the post, which anchors the clamp when inserted into the ground.

The clamp of the anchor can take on various forms. Preferably, the clamp includes opposing clamp members or pieces—a base piece and a head piece. The base piece is located atop the post and the head piece is hingedly connected to the base piece. As described below, the hingedly connected clamp pieces may be held closed by a coil spring. Alternatively, the clamp pieces may be held in a closed position by a latching mechanism.

To hold an anchored object such as the edge of a beach blanket firmly, each clamp piece preferably includes a gripping surface. The gripping surfaces, which are rough and abraded, serve to decrease the likelihood of an inadvertent release of the anchored object. In a preferred embodiment, the gripping surfaces have a saw-toothed shape.

For ease of setting the anchor in its environment of use, preferably the post of the anchor is tapered. The anchor post may be hollow or solid. Depending upon how the anchor is manufactured, the base piece of the clamp may be attached to or formed integrally with the end of the post where the clamp is located.

Figure 1:
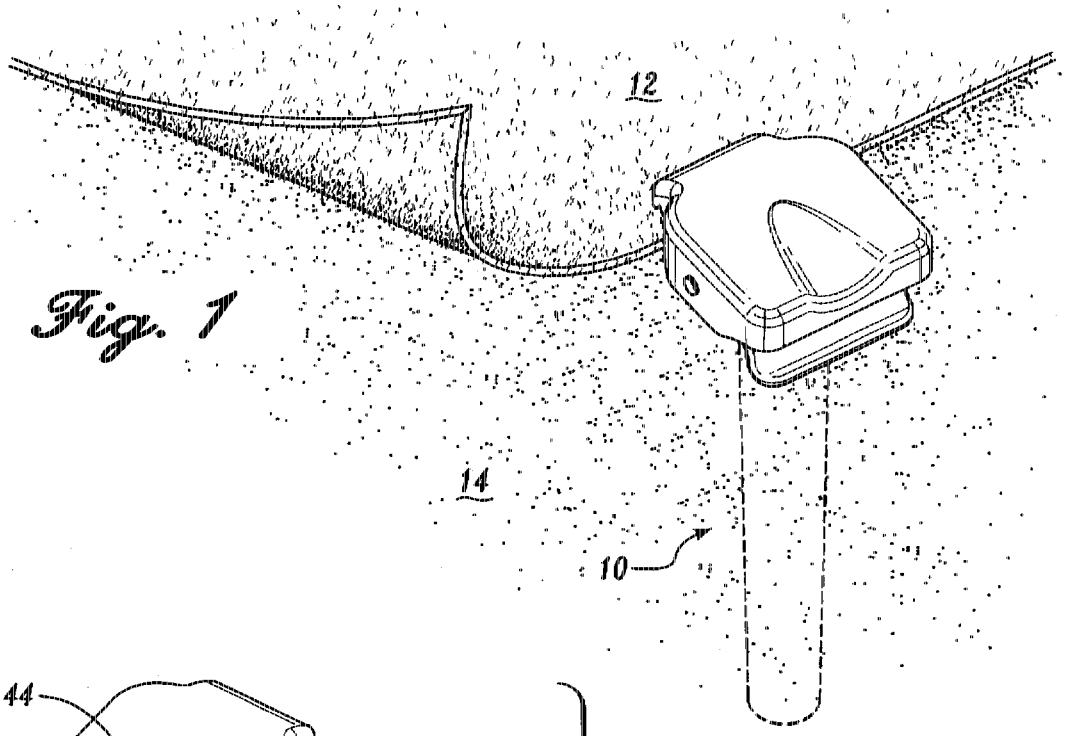
FIG. 1 is a pictorial illustration of a beach blanket anchor formed in accordance with the present invention anchoring a blanket on a beach.

Turning now to the drawings, FIG. 1 illustrates a representative anchor 10 formed in accordance with the present invention shown securing a corner of a beach blanket 12 on a windy, sandy beach 14. An exploded view of the anchor 10 shown in FIG. 1 is shown in FIG. 2.

Figure 2:
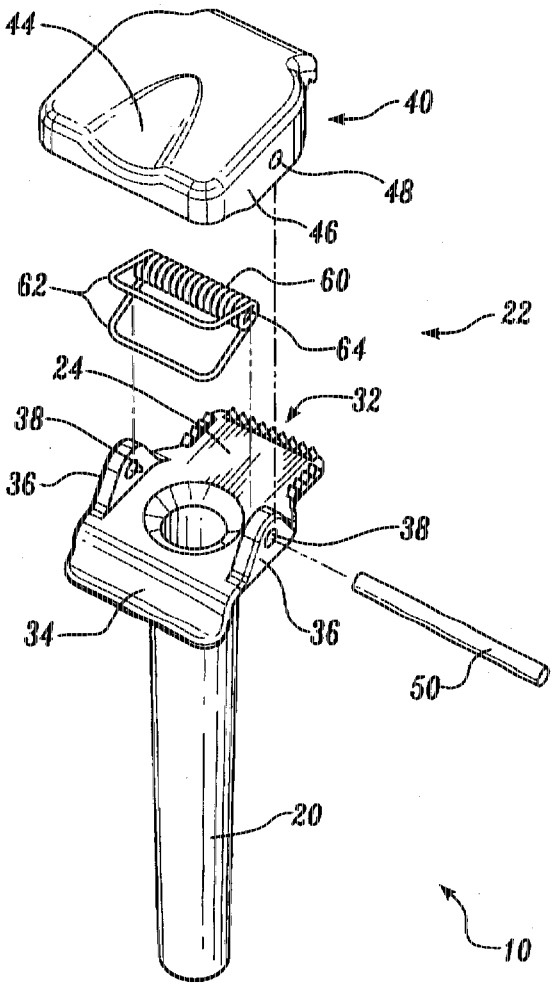
FIG. 2 is an exploded, perspective view of the beach blanket anchor illustrated in FIG. 1.

Referring to FIG. 2, the anchor 10 includes a post 20 and a clamp 22. The clamp 22 includes a base piece 24, a head piece 40, a pin 50 and a coil spring 60. Briefly, the base piece is located atop, i.e., at one end, of the post 20, the head piece 40 is hingedly attached to the base piece by the pin 50 and the coil spring surrounds the pin and forces the jaw side of the clamp closed.

The base piece 24 of the clamp 22 includes a flat center area located atop the post 20. The plane of the flat center area lies orthogonal to the longitudinal axis of the post 20. Located on opposite sides of the flat center region are a pair of upwardly protruding hinge ears 36. The pin 50 passes through holes 38 in the ears 36. Located on one side of the ears is a downwardly protruding tab 34. Located on the opposite side of the ears from the tab is a jaw region that includes upwardly protruding peripheral teeth 32.

As shown best in FIG. 3, the head piece 40 has a rectangular cap shape that includes a pair of downwardly extending walls 46. Located in the walls 46 are holes 48. The holes are positioned so as to be alignable with the holes 38 in the ears 36 of the base piece 24. Further, the holes 48 are sized to receive the pin 50. Formed in the upper surface of the head piece 40, so as to overlie the tab 34 in the base piece 24, is a recess 44. Formed in the opposite end of the head piece 40 is a jaw region that includes a plurality of downwardly projecting teeth 42. The teeth 42 of the head piece 40 are aligned with the teeth 32 of the base piece 24 when the head piece is pinned to the base piece by the pin 50 in the manner described below.

The coil spring 60 includes a coil 64 and a pair of outwardly extending U-shaped arms 62. When the head piece 40 is pinned to the base piece 24 in the manner described below, the coil 64 surrounds the pin 50 and the arms 62 lie between and press against the tab 34 and recess 44 sides of the base and head piece 24 and 40, respectively.

The base piece 24, head piece 40, pin 50 and coil spring 60 are assembled by placing the head piece 40 over the base piece such that the teeth 32 of the base piece 24 are aligned with the teeth 42 of the head piece 40. The base and head pieces are also positioned such that the holes 38 in the ears 36 of the base piece 24 are aligned with the holes 48 in the walls 46 of the head piece 40. Further, the coil spring 60 is positioned between the ears 36 such that the coil 64 is aligned with the holes and such that the arms 62 lie between the tab 34 and recess 44 sides of the base and head pieces, respectively. Thereafter, the pin 50 is inserted through the holes 38 and 48 and through the coil 60.

The length of the post 20 can vary. The preferred range is 4 inches to about 12 inches, with the preferred length being about 6 inches. The diameter of the anchor post can also vary depending upon the desired anchoring capacity. The preferred range is from about 2 inches to about 0.5 inch, with the preferred dimensions being about 1 inch at the base piece end and about 0.6 inch at the top.

In operation, the clamp 40 is opened by a user placing his or her thumb on the depression 44 and the side of his or her index finger beneath the tab 34, and pressing the thumb toward the index finger. The resulting force moves the teeth 42 of the head piece 40 away from the teeth 32 of the base piece 24, against the force of the coil spring 60. After the edge of the object to be held down is placed between the teeth, the force is released resulting in the clamp 40 being attached to the object, e.g., the beach blanket. Then the post 20 is pressed into the ground. Alternatively, the post can be pressed into the ground before the clamp 22 is attached to the object, i.e., the beach blanket. In either case, the teeth tightly grip the object, under the forces of the coil spring.

FIG. 5 illustrates an alternative embodiment of the invention. Rather than using a coil spring to provide the clamping and retention force produced by the clamp, the coil spring is eliminated. The clamp is manually closed over the object to be gripped, i.e., the edge of a beach blanket. Thereafter, a pair of flipper tabs 70, one located on each side of the jaws of the clamp, are latched closed. More specifically, the flipper tabs 70 form a latching mechanism. The flipper tabs 70 are hinged or snap connected to the base piece 24. After the jaw of the clamp is closed by pressing the teeth toward one another, the flipper tabs are closed by coupling the tabs to the sides of the head piece 40.

The pieces of the anchor 10 can be formed of a variety of materials. Preferably, the pin is formed of a suitably strong metal, such as iron or aluminum. The coil spring is formed of a suitably resilient metal. The base piece 24 is preferably integrally formed with the post 20. Preferably, the base piece/post combination and the head piece are injection molded from a suitably tough rigid thermoplastic resin such as ABS or Delrin®, for example. Alternatively, these components can be manufactured from a suitable metal, i.e., aluminum, using conventional casting and machining techniques.

As noted above, to secure the anchor of the present invention in a sandy beach environment, the post means is pressed into the sand. To secure a beach blanket to the sand using the anchor, the clamp is opened and one edge of the beach blanket is inserted between the jaws of the clamp. Release of the clamp if spring loaded, or latching the base and head clamp pieces if flipper latched, secures the blanket to the clamp and, thus, anchors the blanket to the sand. Obviously, several anchors should be used, preferably, at least four located at the corners of the blanket. The use of the anchors of the present invention in a beach setting allows for the carefree use of a beach blanket without the worry that the blanket will be blown away or easily rumpled. The cumbersome use of other traditional and less attractive blanket anchors, such as rocks, driftwood, shoes, and purses, is obviated by the use of anchors formed in accordance with this invention.

While the preferred embodiments of the invention have been illustrated and described, it is to be understood that within the scope of the appended claims various changes can be made therein without departing from the spirit of the invention.

The embodiments of the invention in which an exclusive property or privilege is claimed are defined as follow:

1. An anchor for anchoring blankets, towels and other types of flexible sheets to the ground, said anchor comprising:

A) a post; and

B a clamp located at one end of said post, said clamp comprising:

1) a base piece affixed to said one end of said post, said base piece including:

i) a flat, generally planar region;

ii) a pair of spaced-apart ears integrally formed with and protruding outwardly from the side of said flat, generally planar region remote from said post, each of said ears including a hole for receiving a hinge pin; and iii) a plurality of teeth integrally formed with and protruding outwardly from the side of said flat, generally planar region remote from said post, at least some of said teeth being spaced from and lying parallel to a line extending through said holes in said ears;

2) A head piece hingedly attached to said base piece, said head piece including:

a flat, generally planar region;

a pair of spaced-apart side walls integrally formed with and protruding outwardly from one side of said flat, generally planar region, each of said side walls including a hole for receiving a hinge pin; and iii) a plurality of teeth integrally formed with and extending outwardly from the same side of said generally flat, planar region as said side walls, at least some of said teeth being spaced from and lying parallel to a line extending through said holes in said side walls; and 3) a hinge pin mounted in said holes in said ears and said side walls.

2. The anchor of claim 1, wherein the clamp is a spring-loaded clamp.

3. The anchor of claim 1, wherein the clamp includes flipper tabs for holding the clamp closed.

4. The anchor claimed in claim 1, wherein said head piece includes a recess formed in the side of said flat, generally planar region opposite the side from which said side walls protrude.

5. The anchor claimed in claim 4, wherein said base piece includes a tab aligned with said recess in said head piece.

6. The anchor of claim 5, wherein the clamp is a spring-loaded clamp.

7. The anchor of claim 5, wherein the clamp includes flipper tabs for holding the clamp closed.

8. The anchor claimed in claim 1, wherein said base piece includes a tab protruding outwardly from the side of said flat, generally planar region opposite the side from which said ears protrude.

9. The anchor of claim 8, wherein the clamp is a spring-loaded clamp.

10. The anchor of claim 8, wherein the clamp includes flipper tabs for holding the clamp closed.

* * * * *